US006581789B1

(12) United States Patent
Spanski et al.

(10) Patent No.: US 6,581,789 B1
(45) Date of Patent: Jun. 24, 2003

(54) HIGH-VISIBILITY DISPLAY

(75) Inventors: Jeffrey Lee Spanski, Grayslake, IL (US); Kristen Leanne Lake, Winnetka, IL (US)

(73) Assignee: American Tool Companies, Inc., Vernon Hills, IL (US)

( * ) Notice: Subject to any disclaimer, the term of this patent is extended or adjusted under 35 U.S.C. 154(b) by 0 days.

(21) Appl. No.: 09/637,398

(22) Filed: Aug. 11, 2000

(51) Int. Cl.[7] ..... A47F 5/00

(52) U.S. Cl. ..... 211/106; 211/107; 211/103; 211/57.1; 248/219.1

(58) Field of Search ..... 211/107, 103, 211/106, 59.1, 57.1, 208; 248/218.4, 219.1

(56) References Cited

U.S. PATENT DOCUMENTS

| | | | | |
|---|---|---|---|---|
| 772,558 | A | | 10/1904 | Duff |
| D161,477 | S | | 1/1951 | Lieber et al. |
| 2,692,053 | A | | 10/1954 | Calhoun et al. |
| 2,744,634 | A | | 5/1956 | Conley, Jr. |
| 2,868,385 | A | | 1/1959 | Dreyfus, Jr. |
| 2,961,787 | A | | 11/1960 | Kies |
| 3,153,526 | A | | 10/1964 | Pawsey |
| 3,203,553 | A | | 8/1965 | Pendergrast, Jr. et al. |
| 3,265,246 | A | | 8/1966 | Messenger |
| 3,306,688 | A | | 2/1967 | Di Domenico |
| 3,404,927 | A | | 10/1968 | Mellion |
| 3,484,069 | A | | 12/1969 | Larson |
| 3,662,898 | A | | 5/1972 | Baxendale |
| 3,967,346 | A | | 7/1976 | Young, Jr. |
| 4,015,809 | A | * | 4/1977 | Buril ..... 248/218.4 |
| 4,015,885 | A | | 4/1977 | Baggaley |
| 4,027,799 | A | * | 6/1977 | Stucker ..... 211/106 X |
| 4,343,405 | A | * | 8/1982 | Virte et al. ..... 211/106 |
| 4,742,923 | A | * | 5/1988 | Calvert ..... 211/59.1 |
| 4,776,470 | A | | 10/1988 | Chap |
| 5,220,744 | A | * | 6/1993 | Kendall ..... 248/248.4 |
| D352,848 | S | * | 11/1994 | Dardashti |
| 5,388,709 | A | | 2/1995 | Adams |
| 5,624,040 | A | * | 4/1997 | Hono ..... 211/59.1 X |
| 5,626,318 | A | * | 5/1997 | Boettger et al. ..... 248/218.4 X |
| 5,842,581 | A | | 12/1998 | Graefe |
| 6,006,929 | A | | 12/1999 | Leonard |
| 6,234,330 | B1 | * | 5/2001 | Gray ..... 211/106 |

* cited by examiner

*Primary Examiner*—Robert W. Gibson, Jr.
(74) *Attorney, Agent, or Firm*—Brinks Hofer Gilson & Lione

(57) ABSTRACT

A high visibility display for exhibiting products is provided herein. The display includes a main body configured to straddle a support having a front wall and a pair of opposing sidewalls. At least one securing member is connected to the main body and mounts the main body to the support, allowing the main body to straddle the support. Attached to and extending from a rear edge of one or more of the sidewalls is least one display that can display a plurality of merchandise items.

11 Claims, 4 Drawing Sheets

HIGH-VISIBILITY DISPLAY

FIELD OF THE INVENTION

The present invention relates generally to displays, and, more specifically, to a high visibility display for exhibiting products in conjunction with larger display arrangements in a retail environment.

BACKGROUND

An important factor in the successful merchandising of products is the visibility of the products in retail establishments. Ideally, a product will be exposed to a large number of potential purchasers. Most products, therefore, will be displayed within the main aisles of retail stores and warehouse outlets.

Numerous attempts have been made to maximize the visual exposure of products within such establishments. Typically, products are exhibited on displays facing in a direction substantially perpendicular to the direction customers walk down the aisle. When a customer is not standing directly in front of and facing such a display, however, product visibility is greatly reduced.

An example of a display that provides greater visibility to view items for retail merchandising is disclosed in Leonard U.S. Pat. No. 6,006,929. Display surfaces of the device disclosed in Leonard are set off at angles not perpendicular to the direction that customers walk down the aisle, and hence provide a wider range of visibility. However, these types of displays are typically mounted on flat surfaces, and therefore have the disadvantage of being limited in depth. This results in a smaller display surface and fewer items being able to be exhibited on a display. This requires a merchant to purchase additional displays, which may be impractical due to space constraints and expensive.

SUMMARY OF THE INVENTION

To alleviate the disadvantages of the prior art, a high visibility display is provided herein. The display includes a main body configured to straddle a support having a front wall and a pair of opposing sidewalls. At least one securing member connected to the main body mounts the main body to the support, allowing the main body to straddle the support. At least one display member is attached to and extends from a rear edge of one or more of the sidewalls and displays a plurality of merchandise items.

In another aspect of the invention, the display includes a main body configured to surround at least three sides of a support having a U-shaped top, a U-shaped bottom, and a pair of elongated members connected to the U-shaped top and U-shaped bottom. The U-shaped top and the U-shaped bottom are substantially parallel. At least one securing member connected to the main body mounts the main body to the support. At least one display member is attached to and extends from either of the elongated members and is capable of displaying a plurality of objects.

In another aspect of the invention, the display includes a main body configured to substantially surround a support. At least one securing member extends from the main body and is adapted to mount the main body to the support so that the main body straddles the support. At least one display member capable of exhibiting a plurality of merchandise items is attached to and extends from a rear portion of the main body so that the items are exhibited in an angled and surrounding arrangement relative to a front face of the support.

In another aspect of the invention, the display includes a wire rack configured to straddle a support having a U-shaped top, a U-shaped bottom, and a pair of elongated members connected to a rear portion of the U-shaped top and U-shaped bottom. The top and the bottom can be substantially parallel. A pair of hooks extends upwardly from the U-shaped top and mounts the display to the support so that the wire rack straddles the support. At least one display member is attached to and extends from each of the elongated members and can exhibit a plurality of objects.

The invention provides a display that allows items to be viewed from a number of positions and viewpoints, thus increasing the number of potential purchasers who see the items. Because the display straddles a support, it does not need to be as limited in depth as displays mounted to flat surfaces in order not to intrude into the space where consumers pass. This allows more items to be exhibited on the display, and hence eliminates the number of displays needed.

The foregoing and other features and advantages of the invention will become further apparent from the following detailed description of the presently preferred embodiments, read in conjunction with the accompanying drawings.

DETAILED DESCRIPTION OF THE PRESENTLY PREFERRED EMBODIMENTS

Figure 2:
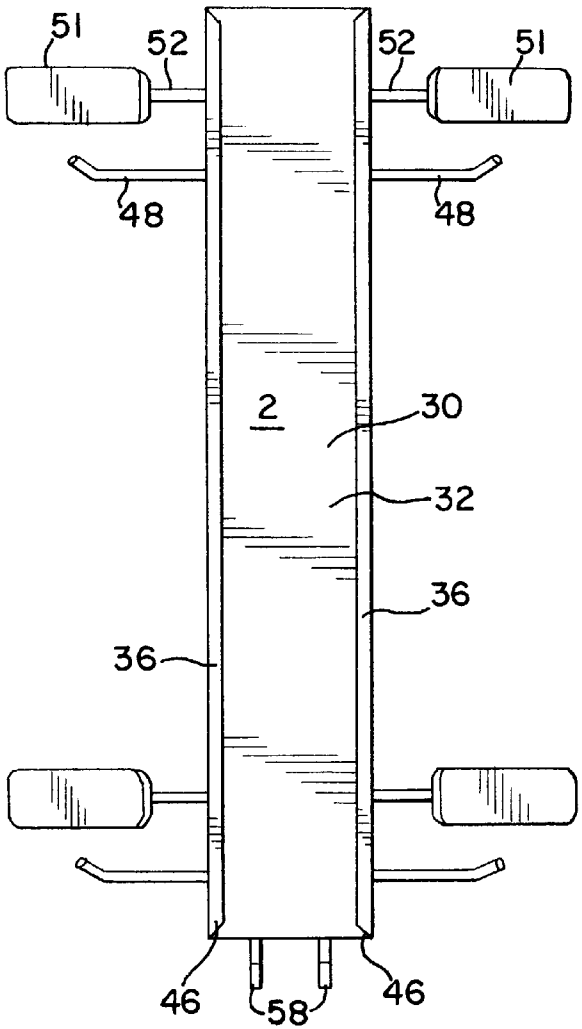
FIG. 2 is a front plan view of the preferred embodiment of FIG. 1.
Figure 3:
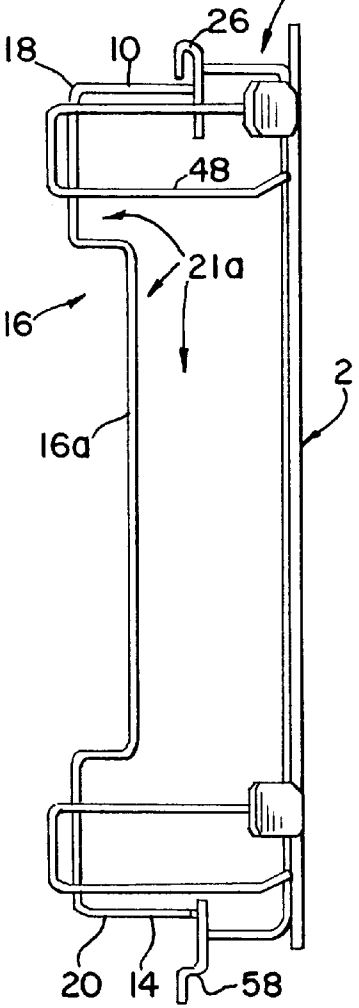
FIG. 3 is a side view of the preferred embodiment of FIG. 1.
Figure 1:
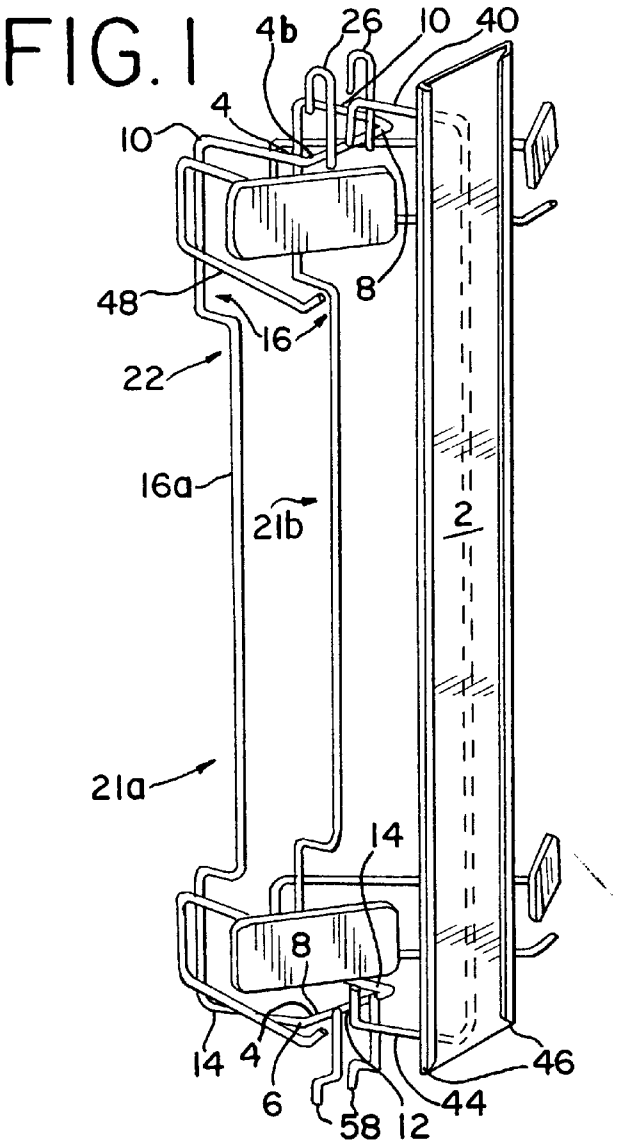
FIG. 1 is a perspective view of the preferred embodiment of the present invention.

An embodiment of the display 2 is shown in FIGS. 1–3. Preferably, the display 2 includes a U-shaped top 4 and a parallel U-shaped bottom 6, each bent from coated steel wire approximately 3/16 inches in diameter. The U-shaped top 4 has a front bar 8 and a pair of opposing sidebars 10. Similarly, the U-shaped bottom 6 also has a front bar 12 and a pair of opposing sidebars 14. The front bar 8 and the front bar 12 together form a front portion of the main body 22 of the display 2. A pair of elongated bars 16 connects the U-shaped top 4 and the U-shaped bottom 6 in a parallel orientation. The elongated bars 16 may include a bent, recessed section 16*a* on each of the bars 16, and are each preferably connected to a back portion 18, 20 of the sidebars 10, 14. Preferably, each of the bars 16 together with the sidebars 10 and 14 define generally planar straddling members 21*a* and 21*b*, respectively.

In the preferred embodiment, the U-shaped top 4, U-shaped bottom 6, and the elongated bars 16 together form a main body 22 that is preferably configured to straddle or surround a support 24 (FIGS. 4–5) via the generally parallel straddling members 21*a* and 21*b*. However, the main body 22 can also be formed in other configurations. For example, instead of being formed from bent wire, the main body 22 can be formed using solid bodies, the solid bodies being, for example, a front wall and a pair of opposing sidewalls attached to side edges of the front wall. The main body 22 can also be one continuous body, made from material such a sheet metal or plastic, that is formed to straddle or surround the support 24. Alternatively, the main body 22 can be a bracket.

The support 24 preferably is a vertical I-beam, but can also take on other configurations, such as a vertically oriented square or round post. Typically, the supports 24 are used in retail or warehouse environments to support large shelves that display bulk retail items, such as lumber materials, for consumer purchase.

Figure 4:
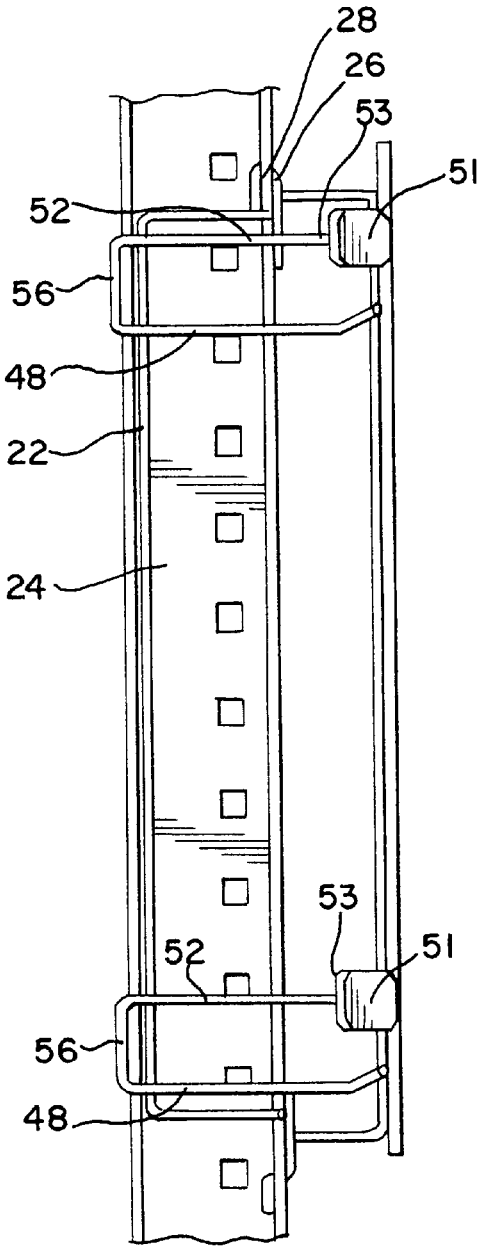
FIG. 4 is a side view of the preferred embodiment of FIG. 1 mounted to a support.
Figure 5:
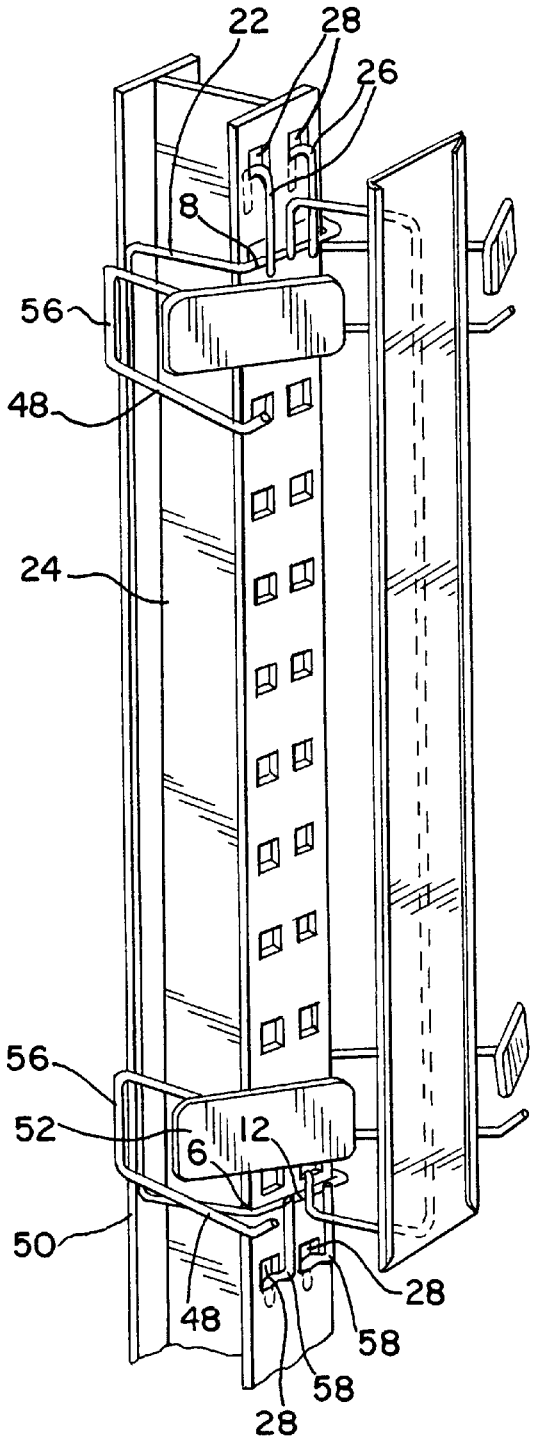
FIG. 5 is a perspective view of the preferred embodiment of FIG. 1 mounted to a support.

A pair of securing members 26 is connected to the main body 22. Preferably, the securing members 26 extend upwardly from the front bar 8 of the U-shaped top 4. As shown in FIGS. 4–5, the securing members 26 preferably are hooks that engage with openings 28 in the support 24, thus allowing the display 2 to be mounted to openings 28 defined in the support 24. However, the securing members 26 can also be embodied in other configurations in order to be compatible with a variety of supports 24. For example, the securing members 26 can be clips. Alternatively, magnets can be used to magnetically mount the display 2 to the support 24 and eliminate the need for openings 28 in the support 24. Additionally, the securing members 26 can be bolts or screws that allow the display 2 to be fixed to the support 24. The securing member could also be a bar that hooked onto hooks on the support 24.

Although a preferred embodiment provides for two securing members 26, in order to be compatible with a variety of supports 24, or to provide more structural security, one securing member 26 or more than two securing members 26 can also be used to mount the display 2. Additionally, the securing members 26 can be located in positions other than the front bar 8. For example, securing members 26 can be located on one or both sidebars 10 of the U-shaped top 4, As another example, the securing members 26 can also be located on the elongated bars 16.

Figure 6:
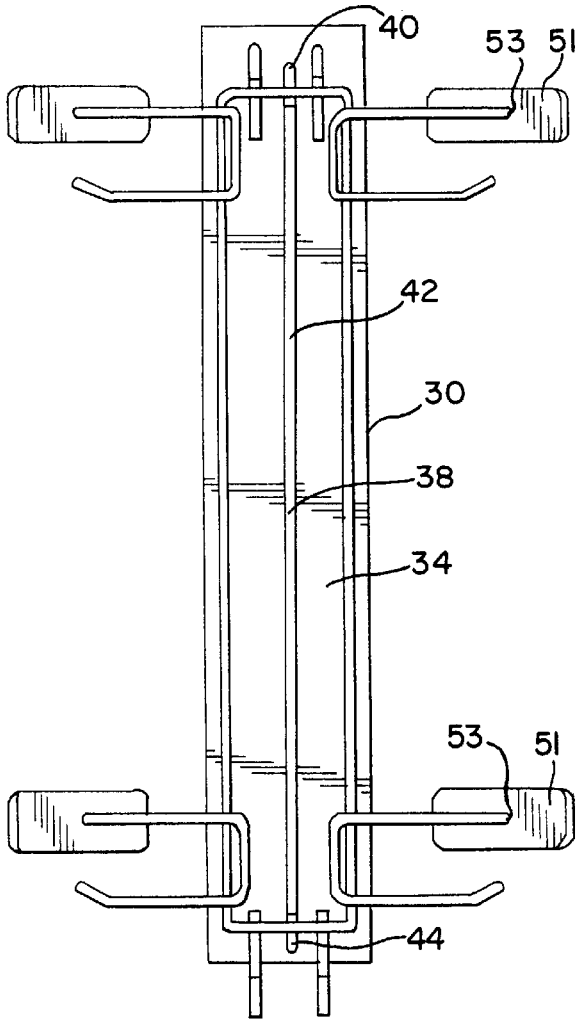
FIG. 6 is a rear plan view of the preferred embodiment of FIG. 1.

Referring to FIGS. 1, 2 and 6, a panel 30 having a front face 32, a back face 34, and a pair of opposing outer edges 36 is attached to the main body 22. In a preferred embodiment, a connector 38 having an upper end 40, a middle portion 42, and a lower end 44 is attached to the back face 34, preferably by welding the middle portion 42 of the connector 38 to the back face 34. Preferably, the connector 38 affixes the panel 30 to the main body 22 by attaching the upper end 40 of the connector 38 to the front bar 8 of the U-shaped top 4 and by attaching the lower end 44 of the connector 38 to the front bar 12 of the U-shaped bottom 6. In other embodiments, the panel 30 can be attached to the main body 22 by affixing the upper end 40 of the connector 38 to the front bar 8 of the U-shaped top 4, or the panel 30 can be directly attached to the front bars 8, 12 of the U-shaped top 4 and U-shaped bottom 6, respectively.

The panel 30 allows information such as advertisements to be displayed. In a preferred embodiment, the outer edges 36 of the panel 30 are folded over to allow an advertisement or information card to be slidably inserted and removed from the panel 30. A lower portion 46 of each outer edge 36 is sealed to the front face 32 of the panel 30 in order to prevent the advertisement or information card from sliding through and separating from the panel 30. Alternatively, the outer edges 36 do not have to be folded over and sealed, and an advertisement or card can be adhesively or frictionally attached to the front face 32 of the panel 30.

A displaying member 48 extends forwardly from an upper portion of the elongated bar 16 at an angle preferably 30 degrees relative to the sidebar 10 of the U-shaped top 4, and can exhibit a plurality of items simultaneously. Setting the displaying member 48 at an angle relative to the support 24 will allow objects exhibited to be more visible than those not angled, which typically are visible only when viewed from a position directly in front of the objects. In other embodiments, the displaying member 48 can be positioned at other angles. However, setting the displaying member 48 at an angle between 30 to 45 degrees is preferable in order to provide high visibility. Furthermore, in other embodiments, depending on space constraints, the displaying member 48 need not be angled at all and instead can be positioned perpendicular to an aisle.

As shown in FIG. 5, when the main body 22 straddles the support 24, the elongated bars 16 of the main body 22 are aligned with a rear portion 50 of the support 24. Hence, the displaying member 48, which in a preferred embodiment is connected to the elongated bar 16, extends forwardly from a point adjacent the rear portion 50 of the support 24. This allows the displaying member 48 to take advantage of the space surrounding the support 24, and the displaying member 48 therefore can be longer in length without intruding into aisle space. The longer length allows the displaying member 48 to retain more items for display. Although the amount the displaying member 48 extends from the elongated bar 16 is not limited, in a preferred embodiment the displaying member 48 will not extend substantially past the panel 30.

The displaying member 48 preferably is a hanger. However, the displaying member 48 can also take on other configurations, such as a shelf or clips. Alternatively, the displaying member can be a vertical channel with a supporting shelf at the lowermost portion of the vertical channel. Items would be stacked on top of the supporting shelf, one on top of the other.

An advertising member 52, suitable for retaining an advertisement, information label, or the like, extends forwardly from the elongated bar 16. Like the displaying member 48 to which the member 52 is preferably substantially parallel, the advertising member 52 preferably extends from the elongated bar 16 at an angle approximately 30 degrees relative to the support 24. However, as with the displaying member 48, in other embodiments the advertising member 52 can be otherwise angled, or need not be angled at all.

A flat panel 51 located on an end portion 53 of the advertising member 52 provides information about the items exhibited by the displaying member 48. Preferably, the information label is adhesively attached to the flat panel 51. However, in other embodiments the flat panel 51 can frictionally retain an information label. Alternatively, similar to the panel 30 described above, outer edges of the flat panel 51 can be folded over and sealed to the remainder of the flat panel 51, allowing advertisements or information labels to be removably engaged with the flat panel 51.

Preferably, a connecting bar 56 attaches the advertising member 52 to the displaying member 48 so that one advertising member 52 corresponds to one displaying member 48. However, in other embodiments the displaying member 48 and advertising member 52 do not need to be connected, as each is attached to the elongated member 16.

Figure 7:
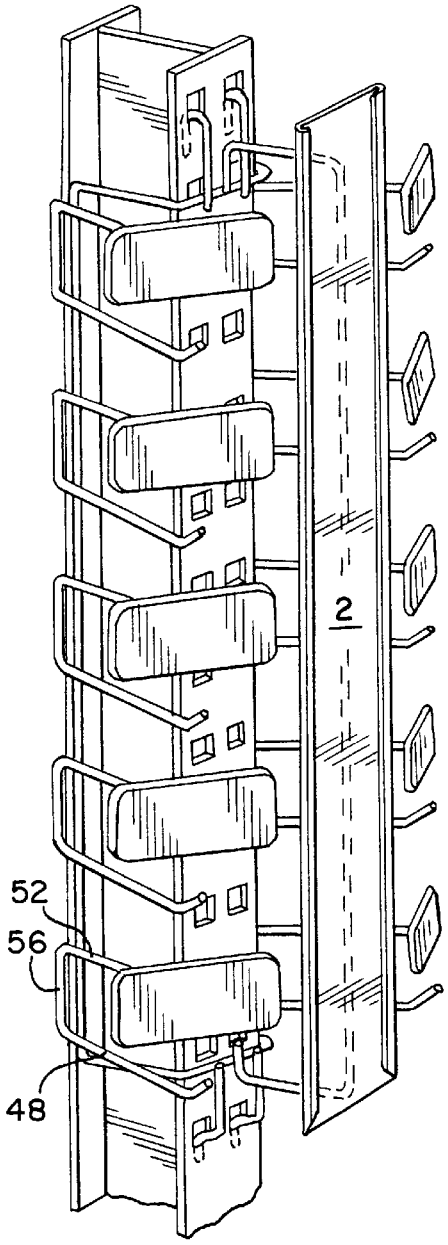
FIG. 7 is a perspective view of a second embodiment of the invention mounted to a support.

Although a preferred embodiment shows two sets of advertising members 52 and displaying members 48 attached to each elongated bar 16 (FIGS. 1–6), as shown in FIG. 7 a different number of advertising members 52 and displaying members 48 can be used with the display 2. Furthermore, in other embodiments a one-to-one correspondence between the displaying members 48 and advertising members 52 is not required.

A pair of guides 58 preferably extends downwardly from the front bar 12 of the U-shaped bottom 6. The guides 58 preferably engage the openings 28 in the support 24, and assist in keeping the display 2 secured in a more stable fashion to the support 24. Although two guides 58 are shown in the preferred embodiment, in order to be compatible with a variety of supports 24, one guide 58 or more than two guides 58 can also be used with the display 2.

The guides 58 also can be located in a position other than the front bar 12 of the U-shaped bottom 6. For example, the guides 58 can also be located on one of the sidebars 14, or on both of the sidebars 14 of the U-shaped bottom 6.

Figure 8:
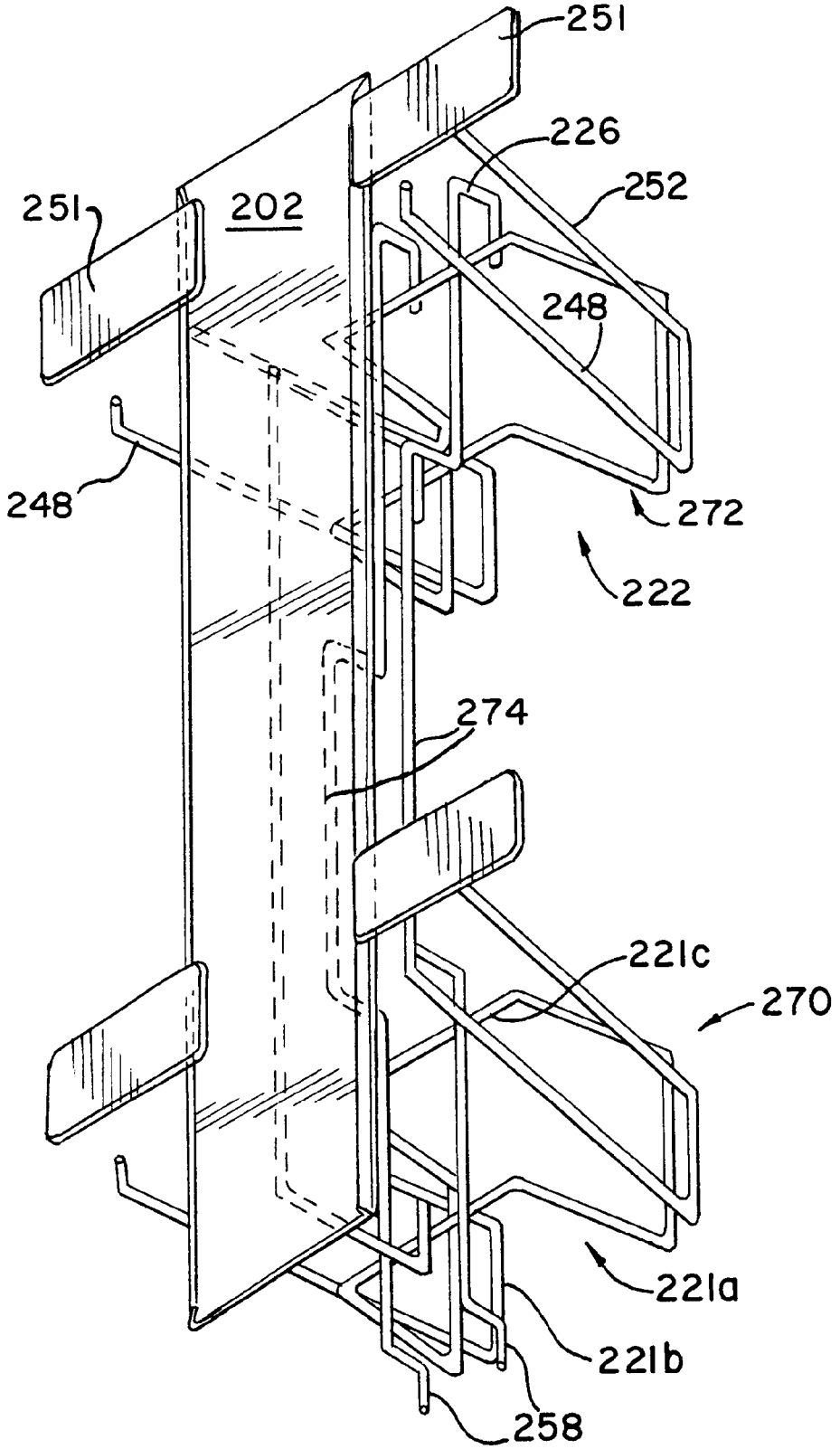
FIG. 8 is a perspective view of a third embodiment of the present invention.

A third embodiment of the invention is shown in FIG. 8, wherein the straddling members of the main body 222 are located on individual, spaced straddling frames. In particular, in this embodiment 202, the main body 222 includes a plurality of straddling frames 270 and 272 located on a lower portion and an upper portion of the body 222, respectively. Each straddling frame 270 and 272 preferably includes a pair of straddling members 221*a* and 221*b* connected by a front frame portion 221*c*, as shown with respect to frame 270 for clarity. A fewer or greater number of straddling members may also be included. The front portion of the main body 222 comprises preferably a pair of elongated front linking members 274. The linking members 274 link the pair of straddling frames 270 and 272. The linking members 274 are preferably linked in turn to guides 258 at a lower portion and securing members 226. In this embodiment, displaying members 248 and advertising members 252 extend at an angle (as described in previous embodiments above) from an end of each straddling member 221*a* and 221*b* on each straddling frame 270 and 272. Flat display panels 251 are preferably mounted to the ends of the advertising members 252 as shown.

The advantages of the above-described embodiments of the invention are numerous. For example, by having the display straddle or surround the support, the display does not need to be as limited in depth as displays that are mounted to flat surfaces in order to avoid intruding into aisle space. Furthermore, this additional depth allows more items to be displayed on the displaying members, and hence fewer displays will be required.

Higher visibility of retail items is another advantage of the above-described embodiments. By setting the displaying members at an angle relative to the support, objects will be able to be viewed from a greater number of positions, thus increasing the number of potential purchasers who see the items.

While the embodiments of the invention disclosed herein are presently considered to be preferred, various changes and modifications can be made without departing from the spirit and scope of the invention. For example, items can be displayed directly by the advertising member. Alternatively, the display can have a displaying member without having an advertising member. The number of advertising member and displaying members can also be varied, without necessarily having the same number of advertising members and displaying members. The scope of the invention is indicated in the appended claims, and all changes that come within the meaning and range of equivalents are intended to be embraced therein.

We claim:

1. A merchandise display for removable attachment to a support, comprising:

a main body having at least a front portion and a pair of generally parallel straddling members;

at least one securing member connected to said main body to mount said main body to said support by interfacing with one side of said support;

at least one display member attached to and extending from one or more of said straddling members;

an advertiser having an end attached to and extending from said main body, wherein said advertiser retains an advertisement to label items displayed by at least one of said display members;

wherein said main body straddles said support when mounted to said support by said securing member, and wherein said display member can display a plurality of merchandise items.

2. A merchandise display for removable attachment to a support, comprising:

a main body having at least a front portion and a pair of generally parallel straddling members;

at least one securing member connected to said main body to mount said main body to said support by interfacing with one side of said support;

at least one display member attached to and extending from one or more of said straddling members, said display member including an ad retainer that can retain an advertisement to advertise items displayed by said display member;

wherein said main body straddles said support when mounted to said support by said securing member, and wherein said display member can display a plurality of merchandise items.

3. A merchandise display for removable attachment to a support, comprising:

a main body having at least a front portion and a pair of generally parallel straddling members;

at least one securing member connected to said main body to mount said main body to said support by interfacing with one side of said support;

at least one display member attached to and extending from one or more of said straddling members;

at least one guide attached to a lower portion of said main body, said guide extending downwardly from said main body and providing additional support to keep said display mounted to said support;

wherein said main body straddles said support when mounted to said support by said securing member, and wherein said display member can display a plurality of merchandise items.

4. The display of claim 3, wherein said guide is located on a lower portion of said front portion.

5. A merchandise display for removable attachment to a support, comprising:

a main body having at least a front portion and a pair of generally parallel straddling members;

at least one securing member connected to said main body to mount said main body to said support by interfacing with one side of said support;

at least one display member attached to and extending from one or more of said straddling members;

a main display attached to said front portion, said main display having a front face and two opposing outer edges and being capable of retaining an advertisement;

wherein said main body straddles said support when mounted to said support by said securing member, and wherein said display member can display a plurality of merchandise items.

6. A high-visibility merchandise display for removable attachment to a support, comprising:

a main body having a U-shaped top, a U-shaped bottom, and a pair of elongated members connected to said U-shaped top and U-shaped bottom, said U-shaped top and said U-shaped bottom being substantially parallel;

at least one securing member connected to said main body to mount said main body to said support by interfacing with one side of said support;

at least one display member attached to and extending from either of said elongated members;

an ad retainer that can retain an advertisement to advertise items displayed by said display member;

wherein said main body surrounds at least three sides of said support when mounted to said support by said securing member, and wherein said display member is capable of displaying a plurality of objects.

7. A merchandise display for removable attachment to a support, comprising:

a main body having at least a front portion and a pair of generally parallel straddling members;

at least one securing member connected to said main body to mount said main body to said support by interfacing with one side of said support;

at least one display member attached to and extending from one or more of said straddling members;

at least one guide attached to said U-shaped bottom, said guide extending downwardly from said u-shaped bottom and providing additional support to keep said display mounted to said support;

wherein said main body straddles said support when mounted to said support by said securing member, and wherein said display member can display a plurality of merchandise items.

8. A merchandise display for displaying items at a variety of angles, mounted to and surrounding a support, comprising:

a main body configured to surround a support;

at least one hooking member extending from said main body and adapted to mount said display to said support;

at least one display member attached to a rear portion of said main body and extending from said rear portion of said main body;

wherein said main body straddles said support when mounted to said support by said hooking member, and wherein said display member can exhibit a plurality of merchandise items in an angled and surrounding arrangement relative to a front face of said support.

9. The display of claim 8, wherein said display member extends from said rear portion of said main body at an angle substantially in the range of 30 to 45 degrees relative to said rear portion of said main body.

10. A high-visibility merchandise display for removable attachment to a support, comprising:

a wire rack having a U-shaped top, a U-shaped bottom, and a pair of elongated members connected to a rear portion of said U-shaped top and a rear portion of said U-shaped bottom, said U-shaped top and said U-shaped bottom being substantially parallel;

a pair of hooks extending upwardly from said unshaped top;

at least two display members, wherein at least one of said display members is attached to and extends from one of said elongated members, and wherein at least one of said display members is attached to and extends from the other of said elongated members;

wherein said wire rack straddles said support when mounted to said support by said hooks, and wherein said display member can exhibit a plurality of objects.

11. The display of claim 10, wherein said display member extends from said elongated member at an angle substantially in the range of 30 to 45 degrees relative to a side member of said U-shaped top.

* * * * *